US005560536A

United States Patent [19]

Moe

[11] Patent Number: 5,560,536

[45] Date of Patent: Oct. 1, 1996

[54] APPARATUS AND METHOD FOR MAKING COAXIAL CABLE HAVING LONGITUDINALLY WELDED OUTER CONDUCTOR

[75] Inventor: Alan N. Moe, Hickory, N.C.

[73] Assignee: CommScope, Inc., Catawba, N.C.

[21] Appl. No.: 389,130

[22] Filed: Feb. 14, 1995

[51] Int. Cl.[6] ..... B23K 13/02

[52] U.S. Cl. ..... 228/102; 228/9; 228/17.5; 228/130; 228/148

[58] Field of Search ..... 228/130, 148, 228/17.5, 9, 102

[56] References Cited

U.S. PATENT DOCUMENTS

| | | | |
|---|---|---|---|
| 2,697,772 | 12/1954 | Kinghorn . | |
| 2,819,369 | 1/1958 | Dexter . | |
| 2,850,998 | 9/1958 | Williams . | |
| 4,156,500 | 5/1979 | Yoshida et al. | 228/130 |
| 4,227,061 | 10/1980 | Westfall et al. | 228/130 |
| 4,287,402 | 9/1981 | Hentzschel et al. . | |
| 4,416,131 | 11/1983 | Davis . | |
| 4,734,981 | 4/1988 | Ziemek . | |
| 4,776,194 | 10/1988 | Chang . | |
| 4,852,790 | 8/1989 | Karlinski . | |
| 5,143,274 | 9/1992 | Laupretre et al. | 228/17.5 |
| 5,148,960 | 9/1992 | Abbey, III et al. | 228/17.5 |
| 5,265,787 | 11/1993 | Ishizaka et al. | 228/17.5 |

FOREIGN PATENT DOCUMENTS

| | | |
|---|---|---|
| 53-36048 | 4/1978 | Japan . |
| 721282 | 3/1980 | U.S.S.R. . |

*Primary Examiner*—P. Austin Bradley
*Assistant Examiner*—Jeffery T. Knapp
*Attorney, Agent, or Firm*—Bell, Seltzer, Park, & Gibson, P.A.

[57] ABSTRACT

An apparatus for making cable including an elongate core and a surrounding longitudinally welded tube includes one or more pairs of opposing tube forming rolls which form a tape into a generally tubular shape surrounding the advancing core. A pair of tube forming rolls define exit tube forming rolls mounted to have an adjustable spacing therebetween. A first sensor generates an exit roll spacing signal which is one parameter that may be displayed to the operator or used to directly to control the spacing. Downstream from an induction welding coil, a pair of opposing weld rolls are mounted to have an adjustable spacing therebetween for permitting setting of a desired pressure between the heated opposing longitudinal edges of the advancing tape. A second sensor generates a weld roll spacing signal which may also be displayed or used to directly control the spacing within a desired range. An associated method is also disclosed.

32 Claims, 3 Drawing Sheets

APPARATUS AND METHOD FOR MAKING COAXIAL CABLE HAVING LONGITUDINALLY WELDED OUTER CONDUCTOR

FIELD OF THE INVENTION

The present invention relates to the field of cable manufacturing, and, more particularly, to an apparatus and method for making coaxial cable.

BACKGROUND OF THE INVENTION

Coaxial cables are widely used for transmitting high frequency electrical signals, such as for transmitting modulated video signals via cable television networks. A coaxial cable typically includes a center conductor, a surrounding layer of dielectric material, and a surrounding tubular outer conductor. An overall protective jacket may also be included surrounding the outer conductor.

Coaxial cable is typically manufactured, such as by the assignee of the present invention, by a multi-step process. A cable core is typically first prepared by extruding a dielectric material layer surrounding an advancing elongate center conductor. The core is then advanced along a predetermined path of travel as a flat conductive tape is advanced adjacent the core. The core and surrounding tape pass through a series of tube forming rolls which progressively shape the flat tape into a generally cylindrical shape having a longitudinally extending gap of predetermined width between adjacent tape edges.

Downstream from the tube forming rolls, the gapped cylindrical tape passes through a weld coil which imparts radio frequency (RF) energy to heat the tape, particularly at the adjacent longitudinal edges. Downstream from the weld coil is a pair of opposing weld rolls which are spaced to cause the heated edges of the tape to press together and form a welded seam including a slightly outwardly protruding weld bead. This protruding bead is removed by a fixed scraper blade downstream from the weld rolls.

The thus-formed outer conductor is slightly larger than the contained core. Accordingly, downstream from the scraper blade, the outer conductor passes through a series of sinking dies which progressively reduce the diameter of the outer conductor until the outer conductor snugly engages the core.

The tube forming rolls are typically rotatably mounted to a frame as are the downstream weld rolls. The tube forming rolls typically have an adjustable spacing between rolls in each pair. The spacings determine how much the tape is worked, or reduced in width, as it passes through the tube forming rolls. The spacing or gap at the last set of rolls of the tube forming rolls is of particular importance in producing higher quality coaxial cable.

Similarly, the pressure applied by the weld rolls to the heated longitudinal edges of the tape may also have a considerable impact on the quality of the longitudinal weld in the outer conductor. The pressure is determined by the spacing between the weld rolls which is also typically adjustable. The pressure serves to mobilize any oxidation on the edges of the tape and remove any irregularities along the untrimmed edges. Imperfections or defects in the outer conductor, and especially periodically occurring defects, may greatly affect high frequency signal performance of the coaxial cable.

The spacings between the tube forming rolls and the weld rolls also affects wear of these components. In particular., if the spaces are too narrow, unnecessary tooling wear may result. The spacings between the exit tube forming rolls and the weld rolls are typically determined by trial and error. Moreover, preferred settings may vary from operator to operator.

Several attempts have been disclosed to measure the external diameter of a longitudinally welded tube to control the quality thereof. For example, U.S. Pat. No. 4,287,402 to Hentzschel et al., discloses an apparatus which measures the upsetting path by measuring a reduction in circumference of the tube from a first point, where the edges are spaced apart and a second point, where the edges are joined downstream from the welding location. The measurement is made by placing markings on respective opposing edge portions of the tube and detecting a change in the separation between the markings by optical scanning means. The measurement signal is compared to a reference value to thereby generate a signal to control the spacing between the weld rolls.

An alternative approach is disclosed in U.S. Pat. No. 4,734,981 to Ziemek which discloses an apparatus for forming a welded metal tube from a metal strip wherein the thickness of the strip is measured and a capstan station provides a pulling or pushing force responsive to the measured thickness to provide greater uniformity of the tube. Similarly, U.S. Pat. No. 2,819,369 to Dexter, Jr. discloses a dimension gauging system including a measuring station which measures the thickness dimension of the material in sheet form. A signal representative of the thickness is stored in memory and, if the thickness of the material passing through the measuring station changes, an imbalance is created in the memory which triggers a resultant change in heat applied at the weld point based upon the thickness in the material.

Coaxial cable preferably has a fairly large bandwidth, on the order of 1 GHz or more. Accordingly, it is desirable to manufacture the coaxial cable to fairly exacting tolerances to obtain uniform high frequency signal transmission characteristics. In particular, the quality of the longitudinal weld in the outer conductor and the diameter of the outer conductor affect cable quality.

In the past, trial and error, as well as operator experience has been used to make the tooling adjustments to produce the cable. Unfortunately, the weld strength of the coaxial cable may typically be tested by destructive testing of samples taken from both ends of the cable reels after it has been manufactured. Accordingly, there is no real time operator feedback based upon weld strength testing. Rather, the operator makes adjustment to the forming roll spacings, and weld roll spacings, for example, based upon visual observation and his experience. For example, the look and feel of a spark plume created as the seam is formed at the weld rolls may be used to adjust the spacing of the weld rolls. More importantly, as operators are rotated, high quality and product uniformity may be difficult to achieve.

SUMMARY OF THE INVENTION

In view of the foregoing background, it is therefore an object of the present invention to provide a method and an apparatus for making a coaxial cable having a high and consistent quality, while preventing unnecessary tooling wear.

These and other objects, features and advantages of the present invention are obtained by an apparatus for making cable of the type including an elongate core and a tubular outer conductor surrounding the core, wherein important tooling parameters are sensed and displayed to the operator in one embodiment of the invention. In another embodiment, the sensed signals are used by a processor to directly control the tooling parameters.

More particularly, the apparatus includes feeder means for advancing the elongate core and an electrically conductive tape together along a predetermined path. One or more pairs of opposing tube forming rolls are positioned along the predetermined path for forming the advancing tape into a generally tubular shape surrounding the advancing core. A pair of tube forming rolls furthest downstream along the predetermined path defines exit tube forming rolls. Exit roll mounting means positioned along the predetermined path mount the exit tube forming rolls to have an adjustable spacing therebetween. A first sensor is positioned along the predetermined path for generating an exit roll spacing signal related to the spacing between the exit tube forming rolls. This exit roll spacing is one important parameter that may be displayed to the operator or used to directly control the spacing. Accordingly, adjusting the spacing between the exit rolls permits setting of the amount of work that the tape is subjected to in passing through the tube forming rolls.

Downstream from an induction welding coil, a pair of opposing weld rolls are mounted to have an adjustable spacing therebetween for permitting setting of a desired pressure between the heated opposing longitudinal edges of the advancing tape. As the edges are pressed together at the weld rolls, a beaded seam is formed and thereby defines a longitudinally welded tube. The longitudinally welded tube is reduced in diameter to fit securely around the underlying cable core. A second sensor is positioned along the predetermined path for generating a weld roll spacing signal related to the spacing between the weld rolls.

Display means, such as a CRT display coupled to a processor, is operatively connected to the first and second sensors. Accordingly, the display may be used for visually displaying first and second values relating to the exit roll and weld roll spacing signals, respectively. The processor preferably includes means cooperating with the display for generating a graph indicating the first and second values relating to the exit roll and weld roll spacing signals along predetermined respective coordinate axes. An operator may compare the displayed values to predetermined settings to make adjustments thereto, or the processor may further include means cooperating with the display for generating on the graph a desired operating window for the respective first and second values.

In an alternate embodiment of the invention, the apparatus also includes first positioning means associated with the exit roll mounting means, and second positioning means associated with the weld roll mounting means. The processor includes means operatively connected to the first and second positioning means for controlling the spacing between the exit tube forming rolls and the spacing between the weld rolls within respective predetermined ranges.

Both the first and second sensors may be provided by an optical sensor. Alternately, speed sensors may be used for indirectly sensing the spacing of the weld rolls. A series of progressively smaller sinking dies are positioned downstream from the weld rolls for reducing a diameter of the advancing longitudinally welded tube to a predetermined output diameter. This diameter reducing operation causes an increase in the downstream linear speed of the advancing longitudinally welded tube relative to the upstream linear speed. Accordingly, the second sensor may include means for sensing linear speeds of the advancing longitudinally welded tube both upstream and downstream from the sinking die means. The processor may thus generate the value relating to the spacing between the weld rolls based upon the sensed linear speeds of the advancing longitudinally welded tube upstream and downstream from the sinking die means, and the predetermined output diameter.

The invention also includes a method for making a cable of a type including an elongate core and a tubular outer conductor surrounding the core. The method preferably includes the steps of: advancing an elongate core and an electrically conductive tape together along a predetermined path; forming the advancing tape into a generally tubular shape surrounding the advancing core by advancing the tape and core through one or more pairs of opposing tube forming rolls while generating an exit roll spacing signal related to the spacing between the exit tube forming rolls; heating the opposing longitudinal edges of the advancing tape downstream from the exit tube forming rolls; forming an advancing longitudinally welded tube by passing the advancing heated tape through a pair of opposing weld rolls having an adjustable spacing therebetween for permitting setting of a desired pressure between the heated opposing longitudinal edges of the advancing tape while generating a weld roll spacing signal related to the spacing between the weld rolls; and visually displaying first and second values relating to the exit roll and weld roll spacing signals, respectively. Rather than displaying the spacings, the signals may be used to directly control the spacings within respective predetermined ranges to both enhance cable quality and reduce unnecessary tooling wear.

The step of visually displaying the first and second values preferably comprises displaying a graph indicating the first and second values relating to the exit roll and weld roll spacing signals, respectively. In addition, a desired operating window may also be displayed for the respective first and second values relating to the exit roll and weld roll spacing signals, respectively.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, the illustrated embodiments are provided so that this disclosure will be thorough and complete, and will fully convey the scope of the invention to those skilled in the art. Like numbers refer to like elements throughout.

Figure 1:
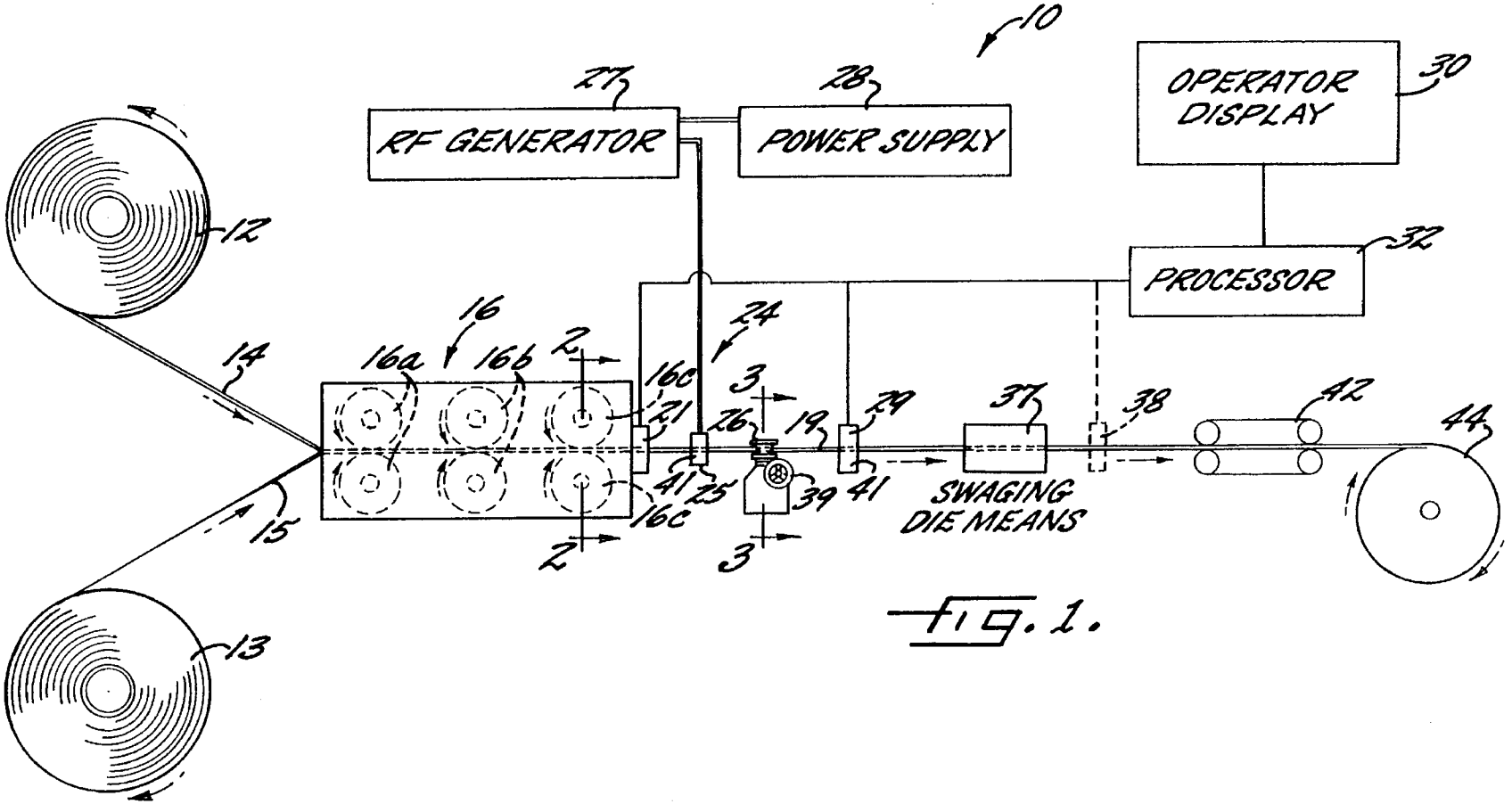
FIG. 1 is a schematic side elevational view of an apparatus according to the present invention for making coaxial cable.
Figure 2:
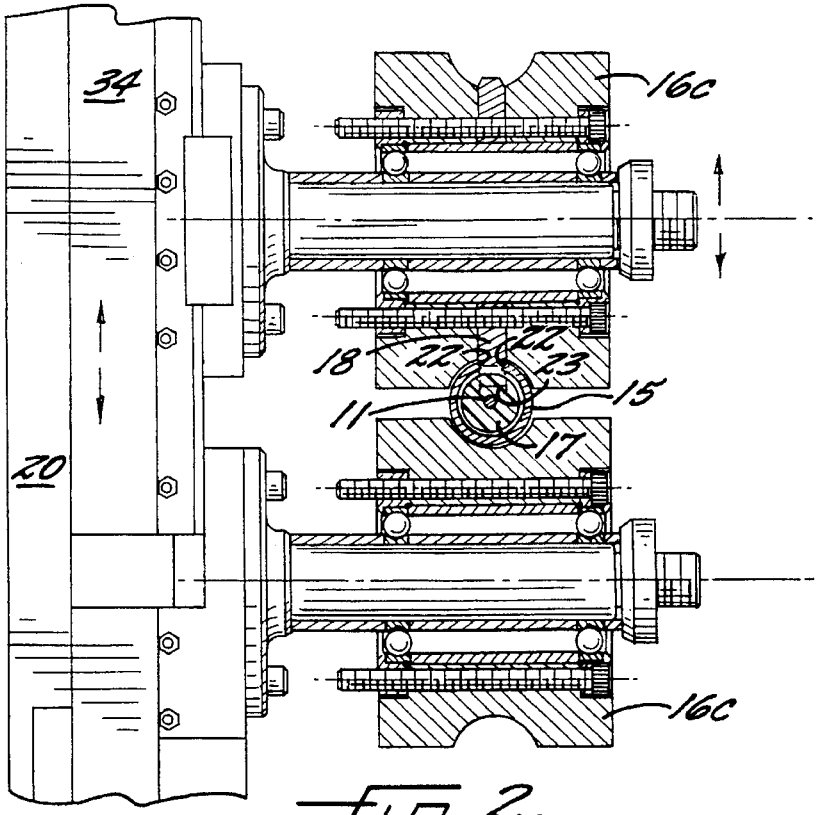
FIG. 2 is a greatly enlarged cross-sectional view taken along lines 2—2 of FIG. 1.
Figure 3:
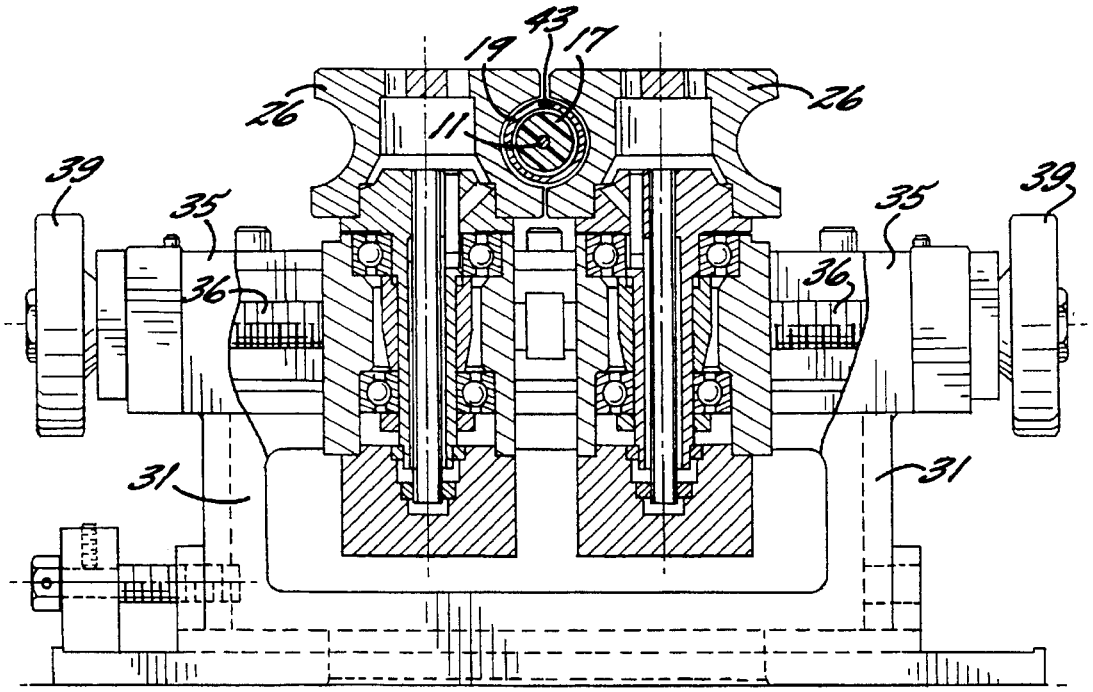
FIG. 3 is a greatly enlarged cross-sectional view taken along lines 3—3 of FIG. 1.

Referring first to FIGS. 1–3, an apparatus 10 according to the invention for making coaxial cable is first schematically illustrated and described. The apparatus 10 includes a coaxial cable core supply 12 and an electrically conductive tape supply 13. The coaxial cable core 14 includes an elongate center conductor 11 and a surrounding layer of dielectric material 17, such as polyethylene foam, as would be readily understood by those skilled in the art. The electrically conductive tape 15 is typically an aluminum tape or strip having a predetermined width and thickness. Feeder means, such as the illustrated traction belts 42, advances the coaxial cable core 14 and the electrically conductive tape 15 together along a predetermined path toward a take-up reel 44.

In the illustrated embodiment, a forming mill 16, comprising one or more pairs of opposing tube forming rolls 16*a*, 16*b* and 16*c*, is positioned along the predetermined path for forming the advancing tape 15 into a generally tubular shape surrounding the advancing core 14. The pair of tube forming rolls furthest downstream along the predetermined path define exit tube forming rolls 16*c*. One of the exit tube forming rolls 16*c* may include a fin 18, as shown in FIG. 2, to ensure a predetermined gap between the opposed longitudinal edges 22 of the advancing tape 15.

Exit roll mounting means 20 positioned along the predetermined path mount the exit tube forming rolls 16*c* to have an adjustable spacing therebetween as shown in FIG. 2. A first sensor 21 is positioned along the predetermined path and measures the gap between the forming rolls, 16*c*. The effective tube diameter can then be calculated by adding the known arc lengths in the tooling to twice the gap or spacing difference, dividing by $\pi$ and subtracting strip thickness, as would be readily understood by those skilled in the art.

The exit roll spacing is one important parameter that may be displayed to the operator or used to directly control the spacing. Accordingly, adjusting the spacing between the exit rolls 16*c* permits setting a desired amount of metal working experienced by the advancing tape in passing through the tube forming rolls, as would be readily understood by those skilled in the art.

The exit roll spacing has upper and lower physical limits. At the upper limit, the exit rolls form a tube wherein the opposing longitudinal edges 22 do not properly engage the fin 18 and a stable weld cannot be formed. At the lower limit, the adjacent tube forming rolls 16*c* may abut each other. Furthermore, as the exit rolls 16 c are brought closer together, the amount of work applied to the tube increases as does tooling wear on the rolls. Between the upper and lower physical limits lies a desired operating window within which a weld of desired quality can be made with an acceptable amount of tooling wear.

Downstream from the first sensor 21, the tube passes through heating means 24 to heat the opposing longitudinal edges 22 of the advancing tape, as best shown in FIG. 1. Heating means 24 illustratively includes an induction welding coil 25, through which the tube passes, and which is operatively connected to a radio frequency (RF) generator 27 and power supply 28.

Downstream from the induction welding coil 25 a pair of opposing weld rolls 26 are mounted for applying a desired pressure between the heated opposing longitudinal edges 22 of the advancing tape. As the edges are pressed together at the weld rolls 26 a beaded seam 43 is formed and thereby defines a longitudinally welded tube 19. The protruding bead is shaved down by a fixed scraper blade (not shown) downstream from the weld rolls 26. The longitudinally welded tube 19 is then reduced in diameter by sinking die means 37 to fit securely around the underlying cable core.

The weld rolls 26 are mounted on weld roll mounting means 31 so as to have adjustable spacing therebetween which permits the setting of the desired pressure to be applied to the opposing longitudinal edges 22 of the advancing tape, as shown in FIG. 3. A second sensor 29 is positioned along the predetermined path and measures the diameter of the tube downstream from the weld rolls 26. The second sensor 29 thus generates a weld roll spacing signal related to the spacing between the weld rolls 26 because the tube diameter is determined by the spacing of the weld rolls 26.

The weld roll spacing is a second important parameter that is displayed to the operator or used to directly control the spacing. Accordingly, adjusting the spacing between the weld rolls 26 facilitates a high quality weld. The weld roll spacing also has upper and lower physical limits. At the upper limit, the weld rolls 26 do not apply sufficient pressure to the opposing longitudinal edges 22 and an unstable weld is formed. At the lower limit, the adjacent weld rolls 26 may abut each other. Furthermore, as the weld rolls 26 are brought closer together, the amount of pressure applied to the tube 19 increases which increases the wear on the rolls. Between the upper and lower physical limits lies a desired operating window within which a weld of desired quality can be made with an acceptable amount of weld roll tooling wear.

The exit roll spacing and weld roll spacing are also interrelated. Specifically, the ratio of the effective tube diameter at the exit rolls 16*c* to the tube diameter after the weld rolls 26 has an upper limit. Beyond this limit a stable weld cannot be formed and the amount of weld roll wear becomes unacceptable. The roll spacing ratio also has a lower theoretical limit of 1.0 where the effective tube diameter at the exit rolls 16*c* is equal to the tube diameter after the weld rolls 26.

Display means, such as a CRT display 30 coupled to a processor 32, is operatively connected to the first and second sensors 21, 29. Accordingly, the display 30 may be used for visually displaying first and second values relating to the exit roll and weld roll spacing signals, respectively. The processor 32 preferably includes means cooperating with the display 30 for generating a graph indicating the first and second values relating to the exit roll and weld roll spacing signals along predetermined respective coordinate axes. An operator may compare the displayed values to predetermined settings to make adjustments thereto, or the processor 32 may further include means cooperating with the display for generating on the graph a desired operating window for the respective first and second values.

Figure 4:
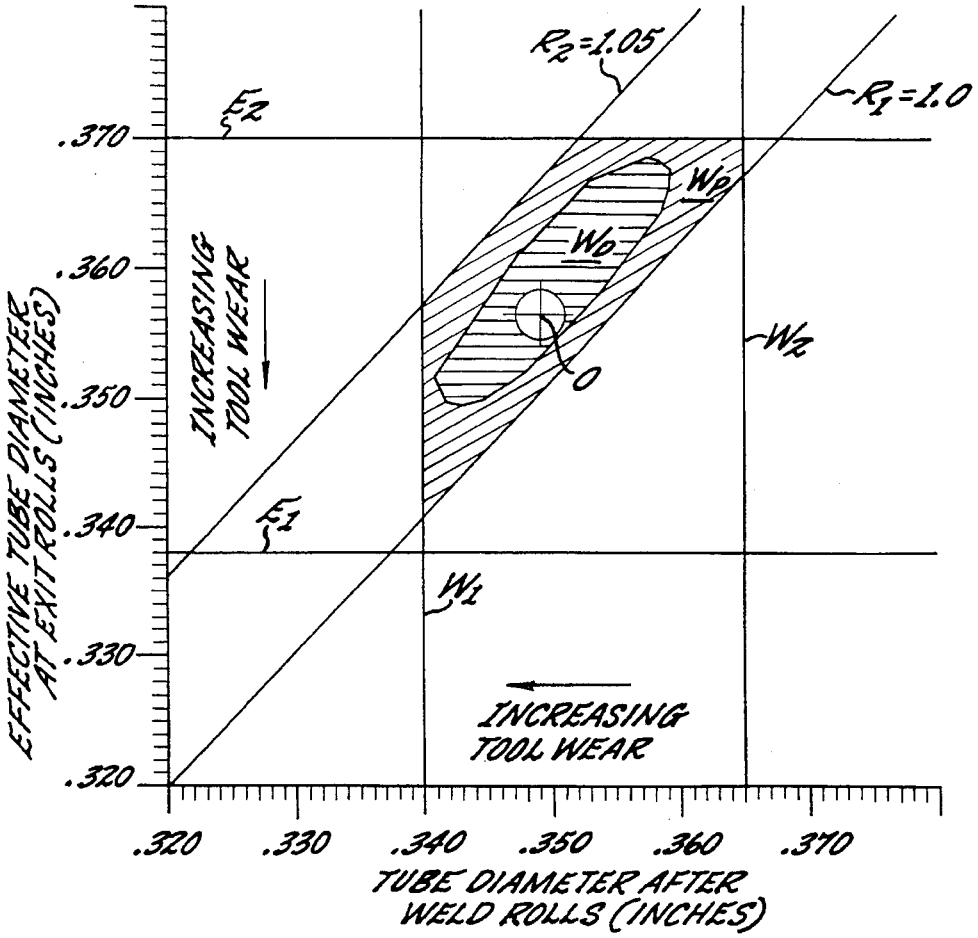
FIG. 4 is an example of a graph illustrating operating parameters for the apparatus according to the invention.

An example of a graph generated by the present invention is shown in FIG. 4. The effective tube diameter at the exit rolls 16*c* as determined by the first sensor 21 is plotted along the ordinate or Y-axis and the tube diameter after the weld rolls 26 is plotted along the abscissa or X-axis. The upper and lower limits of the effective tube diameter at the exit rolls 16*c* are shown as $E_2$ and $E_1$, respectively; the upper and lower limits of the tube diameter after the weld rolls 26 are shown as $W_2$ and $W_1$, respectively; and the upper and lower limits of the roll spacing ratio are shown by $R_2$ and $R_1$, respectively.

As shown in the example graph, the limits define the possible operating window $W_P$ within which the apparatus 10 may be theoretically operated. However, test results of cable samples formed at various points within the possible operating window may empirically define a desired operating window $W_D$. Therefore, tube formed within the desired operating window $W_D$ is of superior quality relative to tube formed outside the desired operating window $W_D$.

The current operational point 0 of the apparatus 10 is shown within the desired operating window $W_D$. If the operating point 0 were outside that window $W_D$, however, the operator could simply adjust the spacing between the exit rolls 16*c* and/or the weld rolls 26 to bring the operating point within the desired operating window. The present invention thus allows an operator to control the roll spacing and weld quality accurately and precisely. Moreover, the sensors 21, 29; the processor 32 and its graph generating means and window generating means all function in "real time" so that the operator can continuously monitor and adjust the roll spacing, if necessary, to provide an assured weld quality. The present invention thus facilitates production of a product of high quality and uniformity.

The apparatus 10 also includes first positioning means 34 associated with the exit roll mounting means 20, and second positioning means 35 associated with the weld roll mounting means 31 for permitting manual adjustment of the roll spacings. The positioning means 34, 35 may comprise, for example, a pair of opposed power screws 36 having hand wheels 39 connected thereto, as shown in FIG. 3.

The positioning means 34, 35 may also include actuators responsive to a control signal for adjusting the roll spacings. Accordingly, the processor 32 may also include means operatively connected to the first and second positioning means 34, 35 for controlling the spacing between the exit tube forming rolls 16*c* and the spacing between the weld rolls 26 within respective predetermined ranges. For example, the processor 32 may be operatively connected to a stepping motor so that the processor can directly control the spacing between the exit rolls 16*c* and the weld rolls 26. Other conventional electromechanical actuators may also be readily used as would be understood by those of skill in the art. Thus, the processor 32 can adjust the roll spacing so as to maintain the current operating point 0 within the desired operating window $W_D$, thereby eliminating the need for operator intervention.

Both the first and second sensors 21, 29 may be provided by an optical sensor 41 which directly or indirectly measures the diameter or effective diameter of the advancing tube. Alternately, the function of the second sensor 29 may be provided by a pair of speed sensors 38 for determining the spacing of the weld rolls 26.

Figure 5:
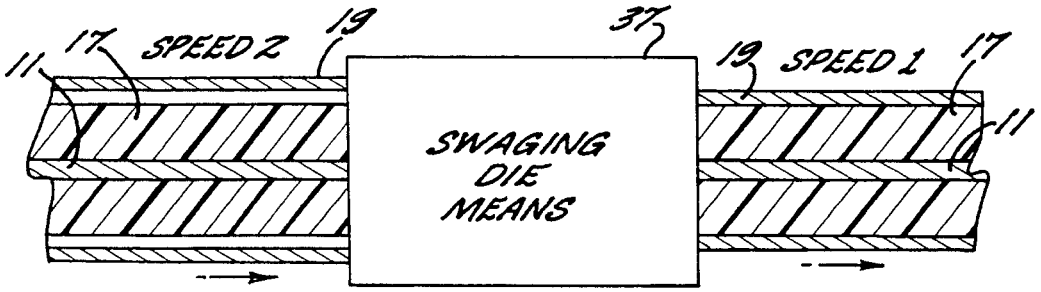
FIG. 5 is a greatly enlarged schematic view of sinking die means of the apparatus according to the invention.

As discussed briefly above, sinking die means 37, preferably comprising a series of progressively smaller conventional sinking dies (not shown), is positioned downstream from the weld rolls 26 for reducing the diameter of the advancing longitudinally welded tube 19 to ensure a secure fit between the tube and the underlying cable core 14. As illustrated in FIG. 5, the sinking die means 37 reduces the diameter of the advancing tube to a predetermined output diameter. As would be appreciated by one of ordinary skill in the art, this diameter reducing operation causes the downstream linear speed of the advancing longitudinally welded tube 19, shown as SPEED 1, to be larger than the upstream linear speed, shown as SPEED 2.

Accordingly, the apparatus 10 may include speed sensors 38 for sensing the linear speed of the advancing longitudinally welded tube 19 both upstream and downstream from the sinking die means 37. The processor 32 may thus generate the value relating to the spacing between the weld rolls 26, such as the effective tube diameter upon exiting the weld rolls, based upon the sensed linear speeds of the advancing longitudinally welded tube 19 upstream and downstream from sinking die means 37 and the predetermined output diameter of the tube emerging from the sinking die means 37.

In particular, the volume of metal entering the sinking die means 37 per unit of time is equal to the volume exiting. Accordingly, assuming that the thickness of the tape does not significantly change in passing through the sinking die means, the surface area of the welded tube upstream of the sinking die means 37 passing a point per unit time is equal to the surface area passing a downstream point per unit of time. Thus, the effective tube diameter at the weld rolls 26 can be readily estimated as equal to ((SPEED1/SPEED 2 OUTPUT DIAMETER)–t), where t is the thickness of the tape.

Since the linear speeds of the tube are readily measured, as would be understood by those skilled in the art, this speed ratio approach may prove more accurate and reliable for estimating the tube diameter at the weld rolls 26 as compared to calculating a diameter based upon arc lengths of the weld rolls and the spacing between the rolls. Also, it has the further benefit of being capable of displaying changes in effective tube diameter due to wear in the weld rolls as they are running. However, the speed ratio approach may prove unsatisfactory if the tape material does follow the assumption that the thickness remains essentially unchanged in passing through the sinking die means 37.

The invention also includes a method aspect for making a cable of a type including an elongate core 4 and a tubular outer conductor 19 surrounding the core. The method preferably includes the steps of: advancing an elongate core 14 and an electrically conductive tape 15 together along a predetermined path; forming the advancing tape 15 into a generally tubular shape surrounding the advancing core 14 by advancing the tape and core through one or more pairs of opposing tube forming rolls 16*a*, 16*b*, 16*c* while generating an exit roll spacing signal related to the spacing between the exit tube forming rolls 16*c*; heating the opposing longitudinal edges 22 of the advancing tape 15 downstream from the exit tube forming rolls 16*c*; forming an advancing longitudinally welded tube 19 by passing the advancing heated tape 15 through a pair of opposing weld rolls 26 having an adjustable spacing therebetween for permitting setting of a desired pressure between the heated opposing longitudinal edges 22 of the advancing tape while generating a weld roll spacing signal related to the spacing between the weld rolls; and visually displaying first and second values relating to the exit roll and weld roll spacing signals, respectively. Rather than displaying the spacings, the signals may be used to directly control the spacings within respective predetermined ranges to both enhance cable quality and reduce unnecessary tooling wear.

The step of visually displaying the first and second values preferably comprises displaying a graph, an example of which is shown in FIG. 4, indicating the first and second values relating to the exit roll and weld roll spacing signals, respectively. In addition, a desired operating window WD may also be displayed for the respective first and second values relating to the exit roll and weld roll spacing signals, respectively.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. An apparatus for making a coaxial cable of a type including an elongate core and a tubular outer conductor surrounding the core, the elongate core including an elongate center conductor and a surrounding layer of dielectric material, said apparatus comprising:

feeder means for advancing the elongate core and an electrically conductive tape together along a predetermined path, the electrically conductive tape having a pair of opposing longitudinal edges;

one or more pairs of opposing tube forming rolls positioned along the predetermined path for forming the advancing tape into a generally tubular shape surrounding the advancing core, a pair of tube forming rolls furthest downstream along the predetermined path defining exit tube forming rolls;

exit roll mounting means positioned along the predetermined path for mounting said exit tube forming rolls to have an adjustable spacing therebetween;

a first sensor positioned along the predetermined path for generating an exit roll spacing signal related to a spacing between said exit tube forming rolls;

heating means positioned downstream from said exit tube forming rolls for heating the opposing longitudinal edges of the advancing tape;

a pair of opposing weld rolls positioned downstream from said heating means;

weld roll mounting means positioned along the predetermined path for mounting said weld rolls to have an adjustable spacing therebetween for permitting setting of a desired pressure between the heated opposing longitudinal edges of the advancing tape to thereby form an advancing longitudinally welded tube surrounding the core;

a second sensor positioned along the predetermined path for generating a weld roll spacing signal related to a spacing between said weld rolls; and display means operatively connected to said first and second sensors for visually displaying first and second values relating to the exit roll and weld roll spacing signals, respectively.

2. An apparatus according to claim 1 wherein said heating means comprises an induction coil surrounding the advancing tape and a power supply connected to said induction coil.

3. An apparatus according to claim 1 wherein said first and said second sensors each comprises an optical sensor.

4. An apparatus according to claim 1 further comprising a processor operatively connected to said first and second sensors and said display.

5. An apparatus according to claim 4 further comprising first positioning means associated with said exit roll mounting means, and second positioning means associated with said weld roll mounting means; and wherein said processor includes means operatively connected to said first and second positioning means for controlling a spacing between said exit tube forming rolls and a spacing between said weld rolls within respective predetermined ranges.

6. An apparatus according to claim 4 wherein said processor comprises means cooperating with said display for generating a graph on said display indicating the first and second values relating to the exit roll and weld roll spacing signals, respectively.

7. An apparatus according to claim 6 wherein said processor further comprises means cooperating with said display for generating on the graph a desired operating window for the respective first and second values relating to the exit roll and weld roll spacing signals, respectively.

8. An apparatus according to claim 4 further comprising sinking die means positioned downstream from said weld rolls for reducing a diameter of the advancing longitudinally welded tube to a predetermined output diameter.

9. An apparatus according to claim 8 wherein said second sensor includes means for sensing linear speeds of the advancing longitudinally welded tube both upstream and downstream from said sinking die means, and wherein said processor further comprises means for generating the value relating to the spacing between said weld rolls based upon the sensed linear speeds of the advancing longitudinally welded tube both upstream and downstream from said sinking die means and the predetermined output diameter.

10. An apparatus for making a cable of a type including an elongate core and a tubular outer conductor surrounding the core, said apparatus comprising:

feeder means for advancing the elongate core and an electrically conductive tape together along a predetermined path, the electrically conductive tape having a pair of opposing longitudinal edges;

one or more pairs of opposing tube forming rolls positioned along the predetermined path for forming the advancing tape into a generally tubular shape surrounding the advancing core, a pair of tube forming rolls furthest downstream along the predetermined path defining exit tube forming rolls;

exit roll mounting means positioned along the predetermined path for mounting said exit tube forming rolls to have an adjustable spacing therebetween;

a first sensor positioned along the predetermined path for generating an exit roll spacing signal related to the spacing between said exit tube forming rolls;

first positioning means associated with said exit roll mounting means for positioning said exit rolls at a desired spacing;

heating means positioned downstream from said exit tube forming rolls for heating the opposing longitudinal edges of the advancing tape;

a pair of opposing weld rolls positioned downstream from said heating means;

weld roll mounting means positioned along the predetermined path for mounting said weld rolls to have an adjustable spacing therebetween for permitting setting of a desired pressure between the heated opposing longitudinal edges of the advancing tape to thereby form an advancing longitudinally welded tube;

a second sensor positioned along the predetermined path for generating a weld roll spacing signal related to a spacing between said weld rolls;

second positioning means associated with said weld roll mounting means for positioning said weld rolls at a desired spacing;

a processor operatively connected to said first and second sensors and said first and second positioning means for maintaining the spacing between said exit rolls and said weld rolls within respective predetermined ranges.

11. An apparatus according to claim 10 wherein said heating means comprises an induction coil surrounding the advancing tape and a power supply connected to said induction coil.

12. An apparatus according to claim 10 wherein said first and said second sensors each comprises an optical sensor.

13. An apparatus according to claim 10 further comprising sinking die means positioned downstream from said weld rolls for reducing a diameter of the advancing longitudinally welded tube to a predetermined output diameter.

14. An apparatus according to claim 13 wherein said second sensor includes means for sensing linear speeds of the advancing longitudinally welded tube both upstream and downstream from said sinking die means, and wherein said processor further comprises means for generating the value relating to the spacing between said weld rolls based upon the sensed linear speeds of the advancing longitudinally welded tube both upstream and downstream from said sinking die means and the predetermined output diameter.

15. An apparatus for making a cable of a type including an elongate core and a tubular outer conductor surrounding the core, said apparatus comprising:

feeder means for advancing the elongate core and an electrically conductive tape together along a predetermined path, the electrically conductive tape having a pair of opposing longitudinal edges;

one or more pairs of opposing tube forming rolls positioned along the predetermined path for forming the advancing tape into a generally tubular shape surrounding the advancing core, a pair of tube forming rolls furthest downstream along the predetermined path defining exit tube forming rolls;

exit roll mounting means positioned along the predetermined path for mounting said exit tube forming rolls to have an adjustable spacing therebetween;

a first sensor positioned along the predetermined path for generating an exit roll spacing signal related to a spacing between said exit tube forming rolls;

heating means positioned downstream from said exit tube forming rolls for heating the opposing longitudinal edges of the advancing tape;

a pair of opposing weld rolls positioned downstream from said heating means;

weld roll mounting means positioned along the predetermined path for mounting said weld rolls to have an adjustable spacing therebetween for permitting setting of a desired pressure between the heated opposing longitudinal edges of the advancing tape to thereby form an advancing longitudinally welded tube;

a second sensor positioned along the predetermined path for generating a weld roll spacing signal related to a spacing between said weld rolls;

a processor operatively connected to said first and second sensors; and a display operatively connected to said processor, said processor further comprising means cooperating with said display for generating a graph indicating on said display the first and second values relating to the exit roll and weld roll spacing signals, respectively.

16. An apparatus according to claim 15 wherein said processor further comprising means cooperating with said display for generating on the graph a desired operating window for the respective first and second values relating to the exit roll and weld roll spacing signals, respectively.

17. An apparatus according to claim 15 further comprising first positioning means associated with said exit roll mounting means, and second positioning means associated with said weld roll mounting means; and wherein said processor includes means operatively connected to said first and second positioning means for controlling a spacing between said exit tube forming rolls and a spacing between said weld rolls within respective predetermined ranges.

18. An apparatus according to claim 15 wherein said heating means comprises an induction coil surrounding the advancing tape and a power supply connected to said induction coil.

19. An apparatus according to claim 15 wherein said first and said second sensors each comprises an optical sensor.

20. An apparatus according to claim 15 further comprising sinking die means positioned downstream from said weld rolls for reducing a diameter of the advancing longitudinally welded tube to a predetermined output diameter.

21. An apparatus according to claim 20 wherein said second sensor includes means for sensing linear speeds of the advancing longitudinally welded tube both upstream and downstream from said sinking die means, and wherein said processor further comprises means for generating the value relating to the spacing between said weld rolls based upon the sensed linear speeds of the advancing longitudinally wielded tube upstream and downstream from said sinking die means and the predetermined output diameter.

22. A method for making a cable of a type including an elongate core and a tubular outer conductor surrounding the core, the method comprising the steps of:

advancing the elongate core and an electrically conductive tape together along a predetermined path, the electrically conductive tape having a pair of opposing longitudinal edges;

forming the advancing tape into a generally tubular shape surrounding the advancing core by advancing the tape and core through one or more pairs of opposing tube forming rolls positioned along the predetermined path, a pair of tube forming rolls furthest downstream along the predetermined path defining exit tube forming rolls having an adjustable spacing therebetween;

generating an exit roll spacing signal related to the spacing between said exit tube forming rolls;

heating the opposing longitudinal edges of the advancing tape downstream from the exit tube forming rolls;

forming an advancing longitudinally welded tube by passing the advancing heated tape through a pair of opposing weld rolls having an adjustable spacing therebetween for permitting setting of a desired pressure between the heated opposing longitudinal edges of the advancing tape;

generating a weld roll spacing signal related to the spacing between said weld rolls; and visually displaying first and second values relating to the exit roll and weld roll spacing signals, respectively.

23. A method according to claim 22 further comprising the step of controlling the spacing between said exit tube forming rolls and the spacing between said weld rolls within respective predetermined ranges.

24. A method according to claim 22 wherein the step of visually displaying the first and second values comprises displaying a graph indicating the first and second values relating to the exit roll and weld roll spacing signals, respectively.

25. A method according to claim 24 wherein the step of displaying the graph further comprises the step of displaying a desired operating window of the graph for the respective first and second values relating to the exit roll and weld roll spacing signals, respectively.

26. A method according to claim 22 further comprising the step of reducing a diameter of the advancing longitudinally welded tube to a predetermined output diameter by passing the advancing longitudinally welded tube through at least one sinking die.

27. A method according to claim 26 wherein the step of generating a signal related to the spacing between said weld rolls comprises the steps of:

sensing linear speeds of the advancing longitudinally welded tube both upstream and downstream from said at least one sinking die; and generating the value relating to the spacing between said weld rolls based upon the sensed linear speeds of the advancing longitudinally welded tube upstream and downstream from said at least one sinking die and the predetermined output diameter.

28. A method according to claim 22 wherein the step of heating comprises advancing the tape through an induction coil while applying power to said induction coil.

29. A method for making a cable of a type including an elongate core and a tubular outer conductor surrounding the core, the method comprising the steps of:

advancing the elongate core and an electrically conductive tape together along a predetermined path, the electrically conductive tape having a pair of opposing longitudinal edges;

forming the advancing tape into a generally tubular shape surrounding the advancing core by advancing the tape and core through one or more pairs of opposing tube forming rolls positioned along the predetermined path, a pair of tube forming rolls furthest downstream along the predetermined path defining exit tube forming rolls having an adjustable spacing therebetween;

generating an exit roll spacing signal related to the spacing between said exit tube forming rolls;

heating the opposing longitudinal edges of the advancing tape downstream from the exit tube forming rolls;

forming an advancing longitudinally welded tube by passing the advancing heated tape through a pair of opposing weld rolls having an adjustable spacing therebetween for permitting setting of a desired pressure between the heated opposing longitudinal edges of the advancing tape;

generating a weld roll spacing signal related to the spacing between said weld rolls; and controlling the spacing between said exit tube forming rolls and the spacing between said weld rolls within respective predetermined ranges based upon the generated exit roll spacing signal and the weld roll spacing signal.

30. A method according to claim 29 wherein the step of heating comprises advancing the tape through an induction coil while applying power to said induction coil.

31. A method according to claim 29 further comprising the step of reducing a diameter of the advancing longitudinally welded tube to a predetermined output diameter by passing the advancing longitudinally welded tube through at least one sinking die.

32. A method according to claim 31 wherein the step of generating a signal related to the spacing between said weld rolls comprises the steps of:

sensing linear speeds of the advancing longitudinally welded tube both upstream and downstream from said at least one sinking die; and generating the value relating to the spacing between said weld rolls based upon the sensed linear speed of the advancing longitudinally welded tube upstream and downstream from said at least one sinking die and the predetermined output diameter.

* * * * *